US005690415A

United States Patent [19]

Krehl

[11] Patent Number: 5,690,415

[45] Date of Patent: Nov. 25, 1997

[54] DISPLAY LIGHT

[75] Inventor: Edward F. Krehl, Eagan, Minn.

[73] Assignee: Stylmark, Inc., Minneapolis, Minn.

[21] Appl. No.: 564,436

[22] Filed: Nov. 29, 1995

[51] Int. Cl.[6] ..... A47F 11/10

[52] U.S. Cl. ..... 362/125; 362/133; 362/370; 108/23

[58] Field of Search ..... 108/23; 312/237; 362/33, 125, 133, 234, 147, 370

[56] References Cited

U.S. PATENT DOCUMENTS

| | | | |
|---|---|---|---|
| 2,106,839 | 2/1938 | Gilbert | 108/23 |
| 3,613,604 | 10/1971 | Butler | 108/42 |
| 3,617,729 | 11/1971 | Lassen | 108/23 |
| 3,664,063 | 5/1972 | Ware | 47/39 |
| 4,359,249 | 11/1982 | Fischer | 312/198 |
| 4,799,133 | 1/1989 | Strzalko et al. | 362/133 |
| 4,926,294 | 5/1990 | Beaulieu et al. | 362/125 |
| 5,040,101 | 8/1991 | Aspenwall | 362/125 |
| 5,097,969 | 3/1992 | Maxworthy | 211/153 |
| 5,269,231 | 12/1993 | Johnson | 108/23 |
| 5,297,863 | 3/1994 | Richardson et al. | 312/128 |

OTHER PUBLICATIONS

"Phantom™ Lighting Brochure", Illuminations Lighting Design, Houston, Texas, no publication date.

*Primary Examiner*—Stephen F. Husar

*Attorney, Agent, or Firm*—Merchant, Gould, Smith, Edell, Welter & Schmidt, P.A.

[57] ABSTRACT

A modular lighted shelf provides a flexible means for displaying and illuminating various items and quantities of merchandise. The modular lighted shelf provides a means to adjust shelf spacing. The shelves include a lamp which illuminates lower shelves. Electrical power for the lamp may be accessed through the shelf structure, and does not limit shelf placement.

26 Claims, 3 Drawing Sheets

FIG. 1
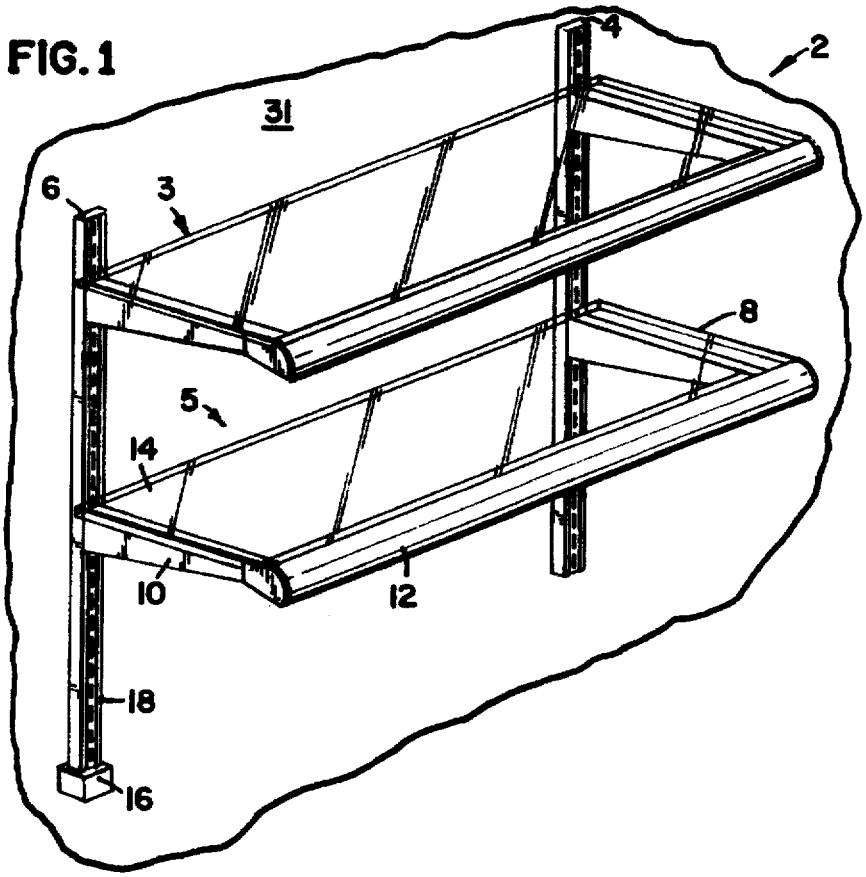
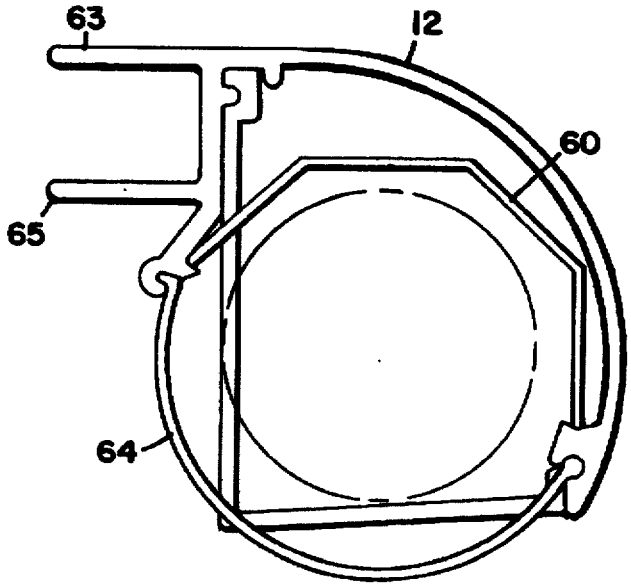
FIG. 5

DISPLAY LIGHT

BACKGROUND OF THE INVENTION

1. Field of the Invention

The invention generally relates to an exhibit system and more particularly to an improved modular lighted shelf for supporting and illuminating articles on display.

2. Description of the Prior Art

Retail stores frequently display large quantities of widely varying merchandise. In successful stores, merchandise inventories turn over quickly. As such stores strive to satisfy changing consumer preferences, the merchandise in inventory may change dramatically over time. The typical store, therefore, requires a flexible way to display their changing merchandise inventories.

One important aspect of retail sales involves displaying the merchandise. Retailers frequently use display shelves for this purpose. Some important factors in such shelving include providing an attractive shelf structure which draws consumers into the store and providing a shelf structure which adjusts both to the size and to the volume of the merchandise currently in inventory. Consequently, retail stores frequently use modular shelving to display merchandise.

Such shelving typically includes a support structure and a number of shelves. Butler (U.S. Pat. No. 3,613,604) discloses such shelving. As is typical, the support structure consists of a pair of parallel tracks. The removable shelves attach to the parallel tracks so that the retail seller may adjust the spacing between shelves to accommodate both the size and quantity of the items being displayed. Furthermore, the shelving structure itself consists of a simple, unobtrusive design so as to focus the consumer's attention on the merchandise.

Another important consideration in retail stores involves lighting the merchandise. The retail store must provide bright light directed towards accentuating the merchandise. Such a lighting plan works to further emphasize the merchandise and thereby focuses the consumer's attention on the retailer's merchandise.

A common way of lighting merchandise on shelves uses overhead spotlights. These spotlights are directed at the retailer's shelves and work to emphasize the retailer's merchandise. Such a lighting plan offers many advantages. For example, a potential customer passing by will quickly notice the well lit merchandise. Additionally, the overhead spotlights do not use any of the limited floor or shelf space in a store. This inconspicuous placement works to avoid distracting a potential customer's attention away from the merchandise.

Such a lighting system, however, also offers some disadvantages. For example, as a customer becomes interested in the merchandise on a particular shelf, the customer will typically approach that shelf. As a result the customer may eventually come in between the spotlight and display, thereby casting a shadow on the very merchandise in which the customer was interested. Such shadows detract from the appeal of the merchandise.

Another method of lighting shelves involves placing lamps on the shelves. Such a lighting method effectively emphasizes the merchandise and avoids the shadows associated with the overhead spotlights. Johnson (U.S. Pat. No. 5,269,231) discloses such a shelving and lighting structure. The Johnson shelves enclose internal wiring and lighting which may be used to illuminate merchandise.

This lighting method, however, is not without its disadvantages. For example, the internal hard-wiring and lighting system of the Johnson shelf prohibits the flexibility associated with modular shelving. More particularly, this shelf structure will not allow a retailer to easily vary the shelving so as to accommodate changing volumes and sizes of merchandise.

In both the lighting from overhead spotlight systems and in the lighting from the above shelf system, transparent shelves are commonly used. Generally, transparent shelves allow light from above to hit a number of shelves. In other words, an overhead light or a lamp on the highest shelf will illuminate merchandise on the first shelf directly below the light. In addition, light which is not absorbed by merchandise on a the first shelf then passes through the first shelf to illuminate merchandise on lower shelves. This process is repeated down to the bottom shelf so that all shelves are illuminated.

The advantages of such an overhead lighting system when used with modular transparent shelves include simplicity and ease of moving shelves to varying heights without affecting the lighting. Unfortunately, however, such systems also include a number of disadvantages. For example, merchandise on a first shelf directly above merchandise on a second shelf will cast a shadow on the merchandise on the second shelf. Such shadows decrease the appeal of the shadowed merchandise. Another problem encountered by such systems involves the refraction of light by the shelves themselves. Depending upon the transparent shelf material, varying amounts of light will be refracted and so will not pass through the shelf. As a result, the lower shelves will appear progressively dimmer because of shadows from merchandise on the higher shelves.

Therefore a need exists for a shelving and lighting system which allows the retailer to vary the placement of the shelves. The shelving and lighting system must provide an unobtrusive and attractive lighting system for effectively illuminating merchandise on all shelves. This lighting system must not limit shelf placement, nor may it use valuable shelf or store space.

SUMMARY OF THE INVENTION

The invention addresses these and other problems associated with the prior art in providing a modular shelving and lighting system. The system provides a support structure upon which shelves may be attached. The support structure allows the shelves to be attached at any number of places so that the retailer may achieve virtually any desired spacing to accommodate store merchandise. In addition, the shelves may be easily removed and reattached at different spacings.

The system also provides electrical access along the support structure. The electricity may be accessed in a manner which allows the shelves to include internal wiring to a lamp housing which may be energized by the electricity. The electricity may be accessed in a manner which does not hinder shelf placement.

The lighting system is directed at illuminating merchandise on the shelves. More specifically, lamps may be located below the shelves, then hardwired through the shelves to the electrical access. The hard-wiring may be removably attached to the electrical access so as not to inhibit shelf placement. As noted above, this type of system reduces unwanted shadows while at the same time allowing the necessary flexibility for varying inventories.

Therefore, in accordance with one aspect of the invention, a modular lighted shelf apparatus is provided for displaying merchandise and the like. The modular lighted shelf apparatus includes a first vertical track; a second vertical track; an electrical bus carried by said second vertical track; a first bracket having a first and second end; a second bracket having a first and second end, a means for operatively connecting said first end of said first bracket to said first vertical track; a means for operatively connecting said first end of said second bracket to said second vertical track; an electrical path having a first end at said first end of said second bracket and second end at said second end of said second bracket, whereby said electrical path transfers electrical energy from said first end to said second end of said electrical path; a means for operatively connecting said first end of said electrical path to said electrical bus; a lamp housing having a first and second end, and a lamp socket; a means for operatively connecting said first end of said lamp housing to said second end of said first bracket; a means for operatively connecting said second end of said lamp housing to said second end of said second bracket; and a means for electrically connecting said lamp socket to said second end of said electrical path.

According to a further aspect of the invention, a modular lighted shelf apparatus is provided for displaying merchandise and the like. The modular lighted shelf apparatus comprising a support structure; an electrical power supply accessible from said support structure; a first shelf; a means for operatively connecting said first shelf to said support structure; a second shelf; a means for operatively connecting said second shelf to said support structure wherein said second shelf is positioned below said first shelf; a lamp socket attached to said first shelf and oriented to illuminate said second shelf; and a means for operatively connecting said lamp socket to said electrical power supply enclosed by said shelf. These and other advantages and features which characterize the invention are set forth in the claims annexed hereto and forming a further part hereof. However, for a better understanding of the invention, and the advantages and objectives attained by its use, reference should be made to the Drawing, and to the accompanying descriptive matter, in which there is described preferred embodiments of the invention.

BRIEF DESCRIPTION OF THE DRAWINGS

FIG. 1 is a perspective view of a preferred embodiment of the lighted shelf apparatus consistent with the invention.

FIG. 5 is a side elevational view of the lamp housing 12 of FIG. 1.

DETAILED DESCRIPTION OF THE PREFERRED EMBODIMENT

Figure 2:
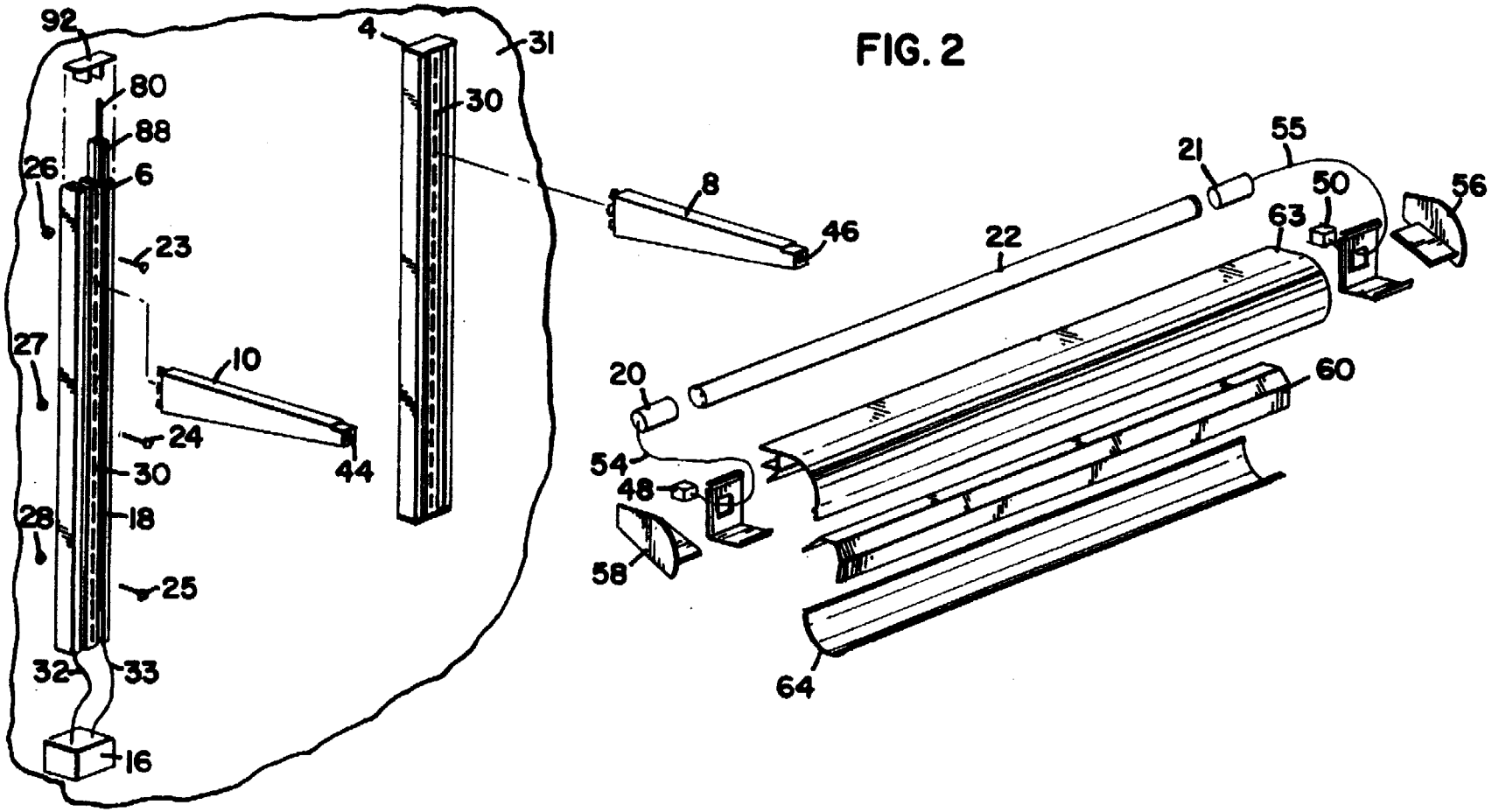
FIG. 2 is an exploded perspective view of the lighted shelf apparatus of FIG. 1.

Turning to the Drawing, wherein like numbers denote like parts throughout the several views, FIG. 1 shows a preferred embodiment of the lighted shelf apparatus 2. The lighted shelf apparatus 2 includes a pair of shelf assemblies 3,5. The number of shelf assemblies may be increased to accommodate more merchandise.

The lighted shelf apparatus 2 includes a pair of vertical tracks 4,6. These vertical tracks provide support for shelf assemblies. The vertical tracks 4,6 attach to a pair of support brackets 8,10 of the shelf assembly 5. The support brackets 8,10, in turn, attach to a lamp housing 12 and provide support to a plate 14 which acts as a shelf for merchandise. Shelf assembly 3 is identical to shelf assembly 5 except that it attaches to the vertical tracks 4, 6 above shelf assembly 5. Each of these components and their attachment means will be discussed in more detail below.

The lighted shelf apparatus 2, also includes a power source 16 which supplies electricity to lamps in the shelf assemblies. The power source 16 is electrically connected to an electric bus 18 which is carried by the track 6. The support bracket 10 then provides a means for connecting the electrical bus 18 to lamp sockets 20, 21 in the lamp housing 12. A lamp 22 is then plugged into lamp sockets 20, 21 where it may be energized by the power source 16.

As may best be seen in FIG. 2, screws 23, 24 and 25 attach vertical track 6 to a support structure 31, in which screw holes 26, 27 and 28 are provided. Depending upon the application, the support structure 31 may comprise a wall, the back of a cabinet, or any other rigid structure. The attachment of vertical track 6 to support structure 31 provides a stable means to support the forces of the support brackets which in turn support shelves and merchandise. Vertical track 4 is similarly attached to a support structure.

Vertical track 6 further comprises a frame member 29 composed of metal and coated with paint or other finishes such as an anodized finish. The frame member 29 includes a series of slots 30 to which the support bracket 10 attaches. Located behind these slots is a ground clip 73. When the hook bracket 66 contacts the ground clip 73, an electrical ground connection is completed. The details of this connection will be discussed in more detail below.

Figure 4:
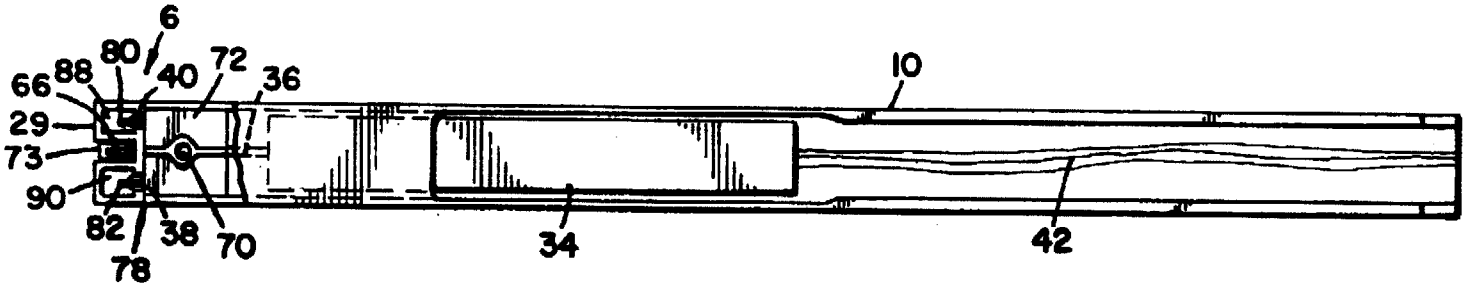
FIG. 4 is a bottom plan view of the support bracket 10 and vertical track 6 of the lighted shelf apparatus of FIG. 1, with portions thereof cut away.

The electrical bus 18 connects to the power source 16 by means of wires 32, 33. As shown in FIG. 4, the electrical bus 18 comprises a pair of electrical tracks 80,82 which consist of ⅛" diameter copper tube. Turning back to FIG. 2, the wires 32, 33 are common electrical type wires having an inner conductor and an outer insulator. The outer insulators of wires 32, 33 are removed proximate to the end which connects to the electrical tracks 80, 82. The exposed inner conductor of wires 32, 33 are then inserted into the hollow copper tubes of tracks 82, 80, respectively. The hollow copper tubes of tracks 80, 82 are then crimped to retain the inserted wires and to from an electrical connection.

The opposite ends of wires 32, 33 connect to the power source 16. The power source 16 may consist of a battery, an electrical outlet or any other source of electrical power. Consequently, the wires may vary in length and gauge to accommodate the power source 16. Additionally in the case of an electrical outlet, the wires may further comprise a plug appropriate for connection to the electrical outlet.

The support bracket 10 encloses a ballast 34. The ballast 34 converts the electrical energy supplied by the power source 16 via the electrical bus 18 to the form of electrical energy required by the lamp 22. The ballast 34 connects to the electrical bus 18 by means of enclosed wires 36, 37 and probes 38,40 which contact the electrical bus 18. The electrical bus provides a hot and a neutral electrical access on tracks 82 and 80, respectively.

In connecting to the electrical bus via wires 36,37 and probes 38,40 the ballast thereby connects both a hot and neutral electrical access from which it may draw electrical energy from the power source 16. The ballast 34 then connects by means of four other enclosed wires 42, to a connector 44 mounted on the outside end of the support bracket 10. The wires 42 supply electric energy to the lamp 22. Bracket 8 also includes a connector 46.

The lamp housing 12 encloses two connectors 48,50 which mate with the bracket connectors 44,46, respectively. When mated, the connectors 44,46,48,50 provide a high friction fit which prevents the lamp housing 12 from inadvertently disconnecting from the brackets. The connection between connectors 44,46,48,50 provide support to the lamp housing 12. Additionally, the connectors 44,48 provide an electrical access to the lamp housing 12. The wires 42, which connect the ballast 34 to the connector 44, complete the electrical paths so that a lamp housing may access the electrical energy supplied by the ballast.

The lamp housing 12 includes lamp sockets 20, 21. The lamp sockets 20, 21 electrically connect by means of wires 54, 55 to the connector 48. A fluorescent lamp 22 is then connected to lamp sockets 20, 21 thereby completing a circuit from the power source 16. The ballast 34 is designed to appropriately convert the electricity from the power source 16 to electricity which may be used by the florescent lamp 22. In other embodiments, however, various lamps may be used. For example, a T8, T5, or T2 florescent lamp may be used or other types of lamps including incandescent or halogen.

When using such other lamps, the appropriate ballast or other means of appropriately converting the electricity provided by the power source will be included. In some cases, this may simply require a direct connection, others may require a transformer or any other type of electrical convertor. In order to prevent connecting a particular lamp to the wrong supply of electricity, the connectors 44,46,48,50 are keyed.

In this embodiment, connectors 44, 46, 48, 50 each have six possible connection points. The connection points of connectors 44, 46 comprise sockets; the connection points of connectors 48, 50 comprise pins whose configuration matches that of the sockets. On connector 44, four of the sockets are electrically connected to the four wires 42, one socket is electrically connected to hook bracket 66 to provide a ground path, and the final remaining socket is plugged. The mating connector 48 provides five pins which match the configuration of the sockets in connector 44. The pin connecting to the grounded socket is electrically connected to lamp housing 12, to complete a grounding path. The remaining pins mate with the remaining sockets to provide electric access to the ballast via wires 42. The pins provide the electric access to lamp sockets 20, 21 via wires 54, 55. As a result, the fluorescent lamp 22 is properly connected to the ballast 34 and therefore to the power source 16. The above pins, then fill five of the six possible connection points of connector 48. The remaining connection point is left empty to correspond to the plugged socket in connector 44. In this sense then, the connectors are keyed. Should the remaining connection point be filled with a pin, the connectors 44 and 48 would be prevented from mating. Additionally, the arrangement of the sockets and pins may be varied so that other embodiments, which provide electric conversion other than a ballast, will be prevented from mating with the lamp housing 12 which provides a fluorescent lamp 22. The connectors 46, 50 are similarly keyed so that other lamp housings will be prevented from mating with bracket 8.

The lamp housing 12 additionally includes end caps 56,58 which improve the overall appearance of the apparatus by hiding the internal workings. The lamp housing 12 also houses a reflector 60. The reflector 60 runs along the length of the lamp housing and resides above the lamp 22 so that it increases the amount of light directed out of the lamp housing 12. In addition, the lamp housing includes a diffuser 64. The diffuser also runs along the length of the lamp housing 12 and resides below the lamp 22. By covering the lamp 22, sockets 20, 21 and other internal structures of the lamp housing 12, the diffuser helps to improve the overall appearance of the shelf structure 2. In use, another shelf will be placed below the shelf housing 12 so the lamp works to illuminate articles placed on lower shelves. The diffuser 64 then helps evenly disperse the light on such articles.

The lamp housing 12 also functions as a shelf support. This may be best viewed in FIG. 3. The lamp housing 12 includes lip 63 and 65 which in combination form a horizontal cavity. This cavity has a vertical opening ranging from ⅜ to ¼ inches. This opening accommodates a plate of the corresponding thickness. The plate fits inside the cavity along one end. The opposite end then rests on brackets 8 and 10. The thickness of the plate and the opening of the cavity are sized to form a close, attractive fit between lip 63 and the plate 14. In the event that a thinner plate need be used, a spacer may be provided which rests along the top of lip 65. This spacer would then decrease the vertical opening of the cavity so that a thinner plate would also form a close, attractive fit with lip 63. Furthermore, the lamp housing may comprise numerous shapes to provide a pleasant overall appearance, including the rounded shape shown in FIG. 5.

In accordance with the principles of the invention, any number of different materials may be used for the plate. Preferably a transparent material such as glass may be used. Transparent materials will allow light from above to pass through and thereby further illuminate any merchandise below. Additionally, such materials have a pleasant appearance which appeals to consumers.

Figure 3:
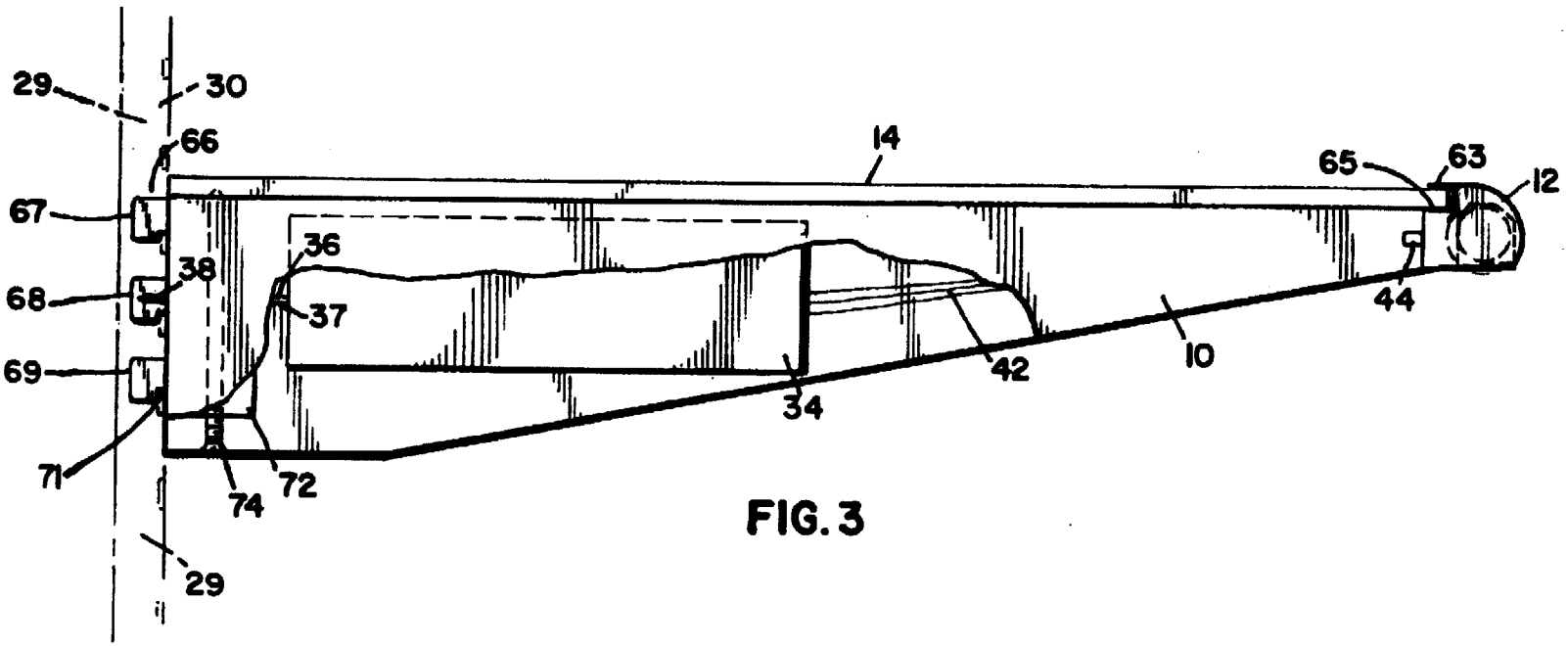
FIG. 3 is a side elevational view of the support bracket 10 and vertical track 6 of the lighted shelf apparatus of FIG. 1, with portions thereof cut away.

As noted above, the support brackets 8,10 attach to the vertical tracks 4,6. The frame member 29 of vertical track 6 supplies attachment points for support bracket 10. Specifically, support bracket 8 attaches to slots 30, by means of a hook bracket 66, as shown in FIG. 3.

The hook bracket 66 includes a set of equally spaced hooks 67, 68, 69 which are sized and spaced to fit inside the slots 30 along the vertical track 6. The hook bracket 66 is sandwiched within an insulating block 72 on the inside of the bracket 10. The insulating block 72 is configured so that the hook bracket 66 is placed in the center of the support bracket 10. The equally spaced hooks 67, 68, 69 of the hook bracket 66 extend beyond the back of the support bracket 10. The hook bracket 66 is then secured to the support bracket 10 by means of a pin 74 which runs between the upper and lower surfaces of the support bracket 10 and through the hook bracket 66. This connection is rigid so that when the bracket is used to support a plate, lamp housing, and merchandise, the hook bracket 66 may be used to secure the support bracket 10 to the vertical track 6. In this way, the connection from the bracket 10 to the hook bracket 66 is sufficient to support loads applied to the bracket 10.

The hooks 67,68,69 may be inserted into the slots 30 until the back of the bracket 10 contacts frame member 29. The notches 71, forming the hooks 67,68,69 in the hook bracket 66 are sized to match the width of frame member 29. Thus, when the hooks 67,68,69 are fully inserted into the slots 30, the notches just reach the inner side of the frame member 29. The entire support bracket 10 may then be slid down. The hooks 67 thereby connect the bracket to the supporting track 29.

Turning now to FIG. 4 in which grounding clip 73 may be viewed. This grounding clip 73, extends along the length of track 6. The grounding clip is configured so that when the hook bracket 66 is inserted into the slots 30 of the electric track 6, the hook bracket 66 forms a snug, friction fit with the grounding clip 73. Both the grounding clip 73 and hook bracket 66 are constructed of conducting material typically a metal, this connection provides an electric grounding path. The grounding clip will further be connected to an external ground which is typically provided through the power source 16.

Another important feature of the shelf apparatus involves the electrical connection between the electric bus 18 and the support bracket 10. The support bracket 10 includes a pair of probes 38,40 which connect to the electrical bus 18. The probes 38,40 are enclosed by insulating block 72 and extend beyond the back end of the bracket 10. The probes 38,40 are retractably spring loaded for contacting the electrical bus 18. As best shown in FIG. 4, the probes are positioned to align with the tracks 80,82 of the electrical bus 18. Thus as the support bracket 10 is attached to the vertical track 6, the probes 38,40 make contact with the tracks 80,82 of the electrical bus 18. As the bracket is pushed against the track, the probes 38,40 retract against internal springs. This allows the hooks to be fully inserted and at the same time results in good electrical contact between the electrical bus and the probes. Furthermore, as can be viewed from FIG. 4, the hook bracket 66 will contact the grounding clip 73 before the probes 38, 40 contact the electric tracks 80, 82. Consequently, a grounding path will be provided to the shelf apparatus before electricity is applied to the circuits enclosed by the shelf assembly 5.

The electrical bus 18 is insulated from the frame member 29 by insulators 88,90. The frame member 29 comprises a pair of cavities which run along the length of the frame member 29 to house insulators 88,90. The cavities each comprise an opening which also runs along the length of the track, however, the opening is not as wide as the cavity, so that the insulators 88,90 are retained within the cavities. Insulators 88,90 are designed so that their outside dimensions match that of the interior dimensions of the track cavities. The cavities are open on each end of the tracks. Thus, the insulators 88,90 may be slid into the cavity along the track 30 from either end. The insulators 88, 90 are sized to form a secure friction fit. In addition, an end cap 92 may be inserted into insulators 88, 90. End cap 92 is also sized to form a secure friction fit.

The insulators 88,90 each comprise a cylindrical cavity which extends along their length to house the electrical tracks 80,82. This cavity comprises an opening which also extends along the length of the insulator and allows the probes 38,40 to contact the electrical tracks 80,32. The opening widens as it extends outward to form a pair of sloping shoulders which extend from the cylindrical cavity. This design facilitates alignment of the probes 38,40 with electrical tracks 82,84 during attachment of the support bracket 10.

The insulating material is sufficiently elastic so that the electrical tracks 80,82, which extends along the length of the insulator may be snapped into the cylindrical cavities. The cavities are sized so that the electrical tracks 80,82 match the dimensions of the cylinders and so are held in place by friction. Thus the electric energy flowing through the electric bus 18 in electrical tracks 80,82 is effectively insulated.

The bracket 8 operates in the same way as bracket 10, but does not include a ballast, probes, or related means for connecting electricity to a lamp. Similarly, the track 4 provides equivalent supporting structure but does not provide an electrical bus. It bears emphasis, however, that other embodiments are envisioned in which the functions of track 6 are included in track 4. Specifically, the track 4 and bracket 8 may provide the electric access provided by track 6 and bracket 10 in the preferred embodiment. Alternately, both tracks 4 and 6 and brackets 8 and 10 could provide an electric access, depending upon the desired arrangement or configuration. Other embodiments might provide electrical access along both tracks so that the shelf assemblies could draw electricity from either tracks. Such an arrangement would help to distribute the electric draw between the two tracks.

Various additional changes and modifications may be made to the preferred embodiments without departing from the spirit and scope of the invention. Therefore, the invention lies solely in the claims hereinafter appended.

The above specification provides a complete description of the manufacture and use of the composition of the invention. Since many embodiments of the invention can be made without departing from the spirit and scope of the invention, the invention resides in the claims hereinafter appended.

I claim:

1. A modular lighted shelf apparatus for displaying merchandise and the like, said modular lamped shelf apparatus comprising:

a) a first vertical track, b) a second vertical track, c) an electrical bus carried by said second vertical track, d) a first bracket having a first and second end, e) a second bracket having a first and second end, f) a means for operatively connecting said first end of said first bracket to said first vertical track, g) a means for operatively connecting said first end of said second bracket to said second vertical track, h) an electrical path having a first end at said first end of said second bracket and second end at said second end of said second bracket, whereby said electrical path transfers electrical energy from said first end to said second end of said electrical path, i) a means for operatively connecting said first end of said electrical path to said electrical bus, j) a lamp housing having a first and second end, and a lamp socket, k) a means for operatively connecting said first end of said lamp housing to said second end of said first bracket, l) a means for operatively connecting said second end of said lamp housing to said second end of said second bracket, m) a means for electrically connecting said lamp socket to said second end of said electrical path.

2. The apparatus as claimed in claim 1, further comprising a lamp connected to said lamp socket.

3. The apparatus as claimed in claim 1, further comprising a shelf supported by a any combination of said first bracket, said second bracket and said lamp housing.

4. The apparatus as claimed in claim 3, wherein said shelf comprises a transparent material.

5. The apparatus as claimed in claim 1, wherein said electrical path further comprises a ballast carried by said second bracket, whereby said ballast acts as a power source to said lamp socket.

6. The apparatus as claimed in claim 1 wherein said means for operatively connecting said first end of said first bracket to said first track, said means for operatively connecting said first end of said second bracket to said second track, and said means for connecting said first end of said electrical path to said electrical bus each comprise a means for a removable connection.

7. The apparatus as claimed in claim 6 wherein said means for operatively connecting said second end of said first bracket to said first end of said lamp housing, said means for operatively connecting said second end of said second bracket to said second end of said lamp housing, and said means for operatively connecting said second end of said electrical path to said lamp socket each comprise a means for a removable connection.

8. The apparatus as claimed in claim 6, wherein said means for operatively connecting said second end of said first bracket to said first end of said lamp housing, said means for operatively connecting said second end of said second bracket to said second end of said lamp housing, and said means for operatively connecting said second end of said electrical path to said lamp socket each comprise a means for a solid connection.

9. The apparatus as claimed in claim 7 wherein said means for operatively connecting said lamp socket to said second end of said electrical path comprises:

a) a first connector electrically connected to said lamp socket, b) a second connector electrically connected to said second end of said electrical path whereby said second connector mates with said first connector, c) a means for keying said first and said second connectors whereby other connectors are prevented from mating with either said first connector or said second connector.

10. The apparatus as claimed in claim 1, further comprising a power source connected to said electrical bus.

11. The apparatus as claimed in claim 3, wherein said first and second shelf comprises a transparent material.

12. A modular lamped shelf apparatus for displaying merchandise and the like, said modular lamped shelf apparatus comprising:

a) a support structure, b) an electrical power source accessible from said support structure, c) a first shelf, d) a means for operatively connecting said first shelf to said support structure, e) a second shelf, f) a means for operatively connecting said second shelf to said support structure wherein said second shelf is positioned below said first shelf, g) a lamp socket attached to said first shelf and oriented to illuminate said second shelf, h) a connecting means for operatively connecting said lamp socket to said electrical power source, wherein said connecting means is enclosed by said shelf.

13. The apparatus as claimed in claim 12, wherein said electrical power source comprises a plurality of access points.

14. The apparatus as claimed in claim 12, wherein said first and second shelf each further comprise:

a) a first bracket, b) a second bracket, c) a lamp housing operatively connected to said first and second brackets, and d) a plate supported by any combination of said first bracket, said second bracket, said lamp housing, and said support structure.

15. The apparatus as claimed in claim 12, further comprising a lamp connected to said lamp socket.

16. The apparatus as claimed in claim 12, wherein said connecting means further comprises a ballast carried by said second bracket, whereby said ballast acts as a power source to said lamp socket.

17. A modular lighted shelf apparatus for displaying merchandise and the like, said modular lighted shelf apparatus comprising:

a) a vertical track, b) an electrical bus carried by said vertical track, c) a bracket having a first and second end, d) a means for operatively connecting said first end of said bracket to said first track, e) an electrical path having a first end at said first end of said bracket and second end at said second end of said bracket, whereby said electrical path transfers electrical energy from said first end to said second end of said electrical path, f) a means for operatively connecting said first end of said electrical path to said electrical bus, g) a lamp housing having a first and second end, and a lamp socket, h) a means for operatively connecting said lamp housing to said second end of said first bracket, i) a means for electrically connecting said lamp socket to said second end of said electrical path.

18. The apparatus as claimed in claim 17, further comprising a lamp connected to said lamp socket.

19. The apparatus as claimed in claim 17, further comprising a shelf supported by any combination of said bracket, and said lamp housing.

20. The apparatus as claimed in claim 19, wherein said shelf comprises a transparent material.

21. The apparatus as claimed in claim 17, wherein said electrical path further comprises a ballast carried by said bracket, whereby said ballast acts as a power source to said lamp socket.

22. The apparatus as claimed in claim 17 wherein said means for operatively connecting said first end of said bracket to said track, and said means for connecting said first end of said electrical path to said electrical bus each comprise a means for a removable connection.

23. The apparatus as claimed in claim 22 wherein said means for operatively connecting said second end of said bracket to said lamp housing, and said means for operatively connecting said second end of said electrical path to said lamp socket each comprise a means for a removable connection.

24. The apparatus as claimed in claim 22, wherein said means for operatively connecting said second end of said bracket to said lamp housing, and said means for operatively connecting said second end of said electrical path to said lamp socket each comprise a means for a solid connection.

25. The apparatus as claimed in claim 23 wherein said means for operatively connecting said lamp socket to said second end of said electrical path comprises:

a) a first connector electrically connected to said lamp socket, b) a second connector electrically connected to said second end of said electrical path whereby said second connector mates with said first connector, c) a means for keying said first and said second connectors whereby other connectors are prevented from mating with either said first connector or said second connector.

26. The apparatus as claimed in claim 17, further comprising a power source connected to said electrical bus.

* * * * *